United States Patent [19]

Sung et al.

[11] Patent Number: 4,834,897

[45] **Date of Patent: * May 30, 1989**

[54] GEAR OIL LUBRICANT ADDITIVE COMPOSITION

[75] Inventors: Rodney L. Sung, Fishkill; Benjamin H. Zoleski, Beacon; Ronald L. O'Rourke, Hyde Park, all of N.Y.

[73] Assignee: Texaco Inc., White Plains, N.Y.

[ * ] Notice: The portion of the term of this patent subsequent to Jun. 30, 2004 has been disclaimed.

[21] Appl. No.: 141,447

[22] Filed: Jan. 7, 1988

[51] Int. Cl.[4] ..... C10M 133/16

[52] U.S. Cl. ..... 252/51.5 A

[58] Field of Search ..... 252/51.5 A

[56] References Cited

U.S. PATENT DOCUMENTS

| | | | |
|---|---|---|---|
| 4,096,077 | 6/1978 | Swakon | 252/51.5 A |
| 4,153,564 | 5/1979 | Chibnik | 252/51.5 A |
| 4,676,917 | 6/1987 | Sung et al. | 252/51.5 A |
| 4,705,642 | 11/1987 | Sung et al. | 252/51.5 A |
| 4,714,561 | 12/1987 | Hoke | 252/51.5 A |

*Primary Examiner*—William R. Dixon, Jr.
*Assistant Examiner*—Jerry D. Johnson
*Attorney, Agent, or Firm*—Robert A. Kulason; James J. O'Loughlin; Vincent A. Mallare

[57] ABSTRACT

This invention provides a gear oil lubricant composition which comprises (a) a major portion of a gear lubricating oil, and (b) a minor amount of, as a friction modifying agent, a reaction product of hydrocarbon-substituted amine, a dibasic acid anhydride and a nitrogen-containing heterocyclic azole compound.

12 Claims, No Drawings

GEAR OIL LUBRICANT ADDITIVE COMPOSITION

FIELD OF THE INVENTION

Energy cost, particularly as illustrated by the cost of crude oil and liquid petroleum distillates derived from crude oil, have escalated rapidly. These costs are especially burdensome to the consumers. Any material, which can be added to a lubricant which will promote fuel economy in today's energy conscious world, is important. One area where such materials could be advantageously utilized is in gear oil lubricants.

BACKGROUND OF THE INVENTION

There are many instances as well known, particularly under boundary lubrication conditions, where two rubbing surfaces must be lubricated, or otherwise protected, so as to prevent wear and to insure continued movement. Moreover, where, as in most cases, friction between the two surfaces will increase the power required to effect movement and where the movement is an integral part of an energy conversion system, it is most desirably to effect the lubrication in a manner which will minimize this friction. As is also well know, both wear and friction can be reduced, with various degrees of success, through the addition of a suitable, or combination thereof, to a natural or synthetic lubricant. Similarly, continued movement can be insured, again with varying degrees of success, through the addition of friction modifier.

Numerous means have been employed to reduce the friction in internal combustion engines. These range from the use of lower viscosity lubricating oils, or mixtures of mineral and synthetic lubricating oil, as well as to the incorporation of friction-reducing additives such as graphite, molybdenum compounds and other chemical additives. There are limits to the extent to which the viscosity of a lubricaitng oil can be reduced for the purpose of reducing friction. Generally, a lubricating oil, having too light a viscosity, will fail to prevent metal-to-metal contact during high-load operating conditions with the result that unacceptable wear will occur in the engine.

One area where there is a renewed interest in ways to promote better fuel economy through lower friction while maintaining adequate wear performance is in gear oil lubrication. The gear assemblies involved are manual transmissions, front and rear axles, manual transaxler, differentials and auxiliary gear cases.

It is an object of this invention to provide a novel gear oil composition for a fuel economy improvement.

INFORMATION DISCLOSURE STATEMENT

U.S. Pat. No. 4,536,189 teaches the art of using a reaction product of a hydrocarbon-substituted mono-primary ether amine, maleic anhydride and nitrogeneous heterocycles, a novel corrosion inhibitor for neat alcohol fuels.

U.S. Pat. No. 4,579,673 discloses a rust-inhibited lubricant composition comprising a major amount of grease and a minor amount of a rust inhibitor additive which is the reaction product of a t-alkyl primary amine, a dialkylamine and maleic anhydride.

U.S. Pat. No. 4,557,848 discloses a novel slow speed marine diesel engine crankcase lubricant characterized by decreased haze and increased corrosion inhibition, where said lubricant comprises a major amount of a mineral lubricating oil and a minor amount of a mineral lubricating oil and a minor amount of a rust and haze inhibiting addtive of the formula $$R(OCH_2CH_2)_a(OCH_2\underset{\underset{CH_3}{|}}{CH})_bNR'_2$$

wherein R is alkyl, aralkyl, alkaryl, aryl, or cycloalkyl, R' is hydrogen or alkyl, a is 1-10, and b is 1-15.

U.S. Pat. No. 4,536,189 discloses a novel corrosion inhibitor which is the reaction product of maleic anhydride, a hydrocarbon-substituted mono primary amine or ether amine, and a heterocyclic compound which may be either benzotriazole or 5-amino-1,3,4,-thiadiazole-2-thiol, and motor fuels containing said novel corrosion inhibitors.

U.S. Pat. No. 4,464,276 describes the preparation of novel polyoxyalkylene polyamine-triazole complexes and their use in diesel lubricant compositions as antioxidants and corrosion-inhibitors.

U.S. Pat. No. 4,326,987 discloses a rust and corrosion inhibitor usefule in petroleum products which is the reaction product of an alkenyl or alkyl succinic acid/anhydride and an alkyl ether diamine;

U.S. Pat. No. 4,282,008 describes a novel corrosion inhibited fuel composition comprising gasoline, methanol or ethanol, and a minor amount of a corrosion inhibitor which is the reaction product of isatoic anhydride, a $C_3$–$C_{12}$ polyprimary amine, and an aminotriazole.

API Chemical Products Abstract, Vol. 84, paragraph 84-50741 (Feb. 20, 1984) describes South African Patent AZ 8208904 which discloses the use of the reaction product of various aliphatic dicarboxylic compounds with various amide compounds as an additive for reducing the cloud point of middle distillates.

API Petroeum and Specialty Products Abstract, Vol. 84, paragraph 84-20587 (Mar. 5, 1984) describes German Pat. No. DE 3320720 which discloses the use of the reaction product of a vinyl acetate-unsaturated dicarboxylic acid compound copolymer with at least one primary amine-containing compound as an additive for corrosion inhibition and cloud point induction in middle distillates.

API Petroleum and Speciality Products Abstract, Vol. 83, paragraph 83-210009 (May 2, 1983) describes European Patent EP 71513 which discloses the use of the reaction prodcut of a dicarboxylic acid anhydride and a primary amine-containing compound as an additive for corrosion inhibition and cloud point reduction in middle distillates.

API Primary Petroleum Products Abstract, Vol. 81, paragraph 81-220055 (Nov. 23, 1981) describes European Patent EP 34968 which discloses the use of the reaction product of maleic anhydride, and oxylalkylated alcohol and a hydrocarbyl amine as a detergent and antitrust additive for motor fuels.

SUMMARY OF THE INVENTION

The gear oil engine lubricant composition of this invention comprises (a) a major portion of a gear oil lubricating oil, and (b) a minor amount of, as a friction modifying agent, a reaction product prepared by reacting (i) a dibasic acid anhydride (ii) a hydrocarbon-substituted mono primary amine, etheramine or mono primary ether, and (iii) a nitrogen containing heterocyclic azole or a polyalkylene polyamine.

The reaction product is prepared by first reacting at a temperature ranging from 75C to about 180C substantially equimolar amounts of an acid anhydride and a hydrocarbon-substituted mono primary amine, etheramine or mono primary ethermine. The acid anhydride reactant which may be a dibasic acid anhydride is represented by the formula

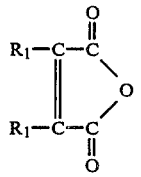

where $R_1$ is H, $CH_3$ or $C_2H_5$. Accordingly, dibasic acid anhydrides suitable for use include maleic anhydride, alphamethyl maleic anhydride, and alpha-ethyl maleic anhydride.

To produce the final reaction product, the intermediate reaction product is thereafter reacted at an elevated temperature with a substantially equimolar of a nitrogen-containing hetercyclic azole or a polyalkylene polyamine. The nitrogen-containing hetercyclic azole compound may be selected from the group consisting of tolytriazole (hereinafter referred to as TTZ) or benzotriazole (hereinafter referred to as BTZ).

If a hetercyclic reactant is employed, it will preferably be a benzotriazole, including those bearing inert substituents, typified by hydrocarbon or alkoxy groups which do not react in the instant invention; or if a polyalkylene polyamine is employed, it will, preferably, be a diethylene triamine.

DETAILED EMBODIMENTS OF THE INVENTION

The lubricants set forth by the instant invention include gear oils which are employed in manual transmission, front and rear axles, manual axles differential and auxiliary gear cases.

The novel anti-wear and friction modifier containing gear oil of the instant invention comprises a major amount of a base hydrocarbon lubricant oil and from 0.1 to 5.0 wt.%, preferably 0.5 to 2.0 wt%, of an additive which is the reaction product of a prescribed anhydride compound which is a dibasic acid anhydride, a hydrocarbon-substituted mono primary amine, ether amine or mono primary etheramine and a nitrogen-containing hetercyclic azole or a polyalkylene polyamine.

The base hydrocarbon oil which may be employed to prepare the gear oil composition of the invention includes a mixture paraffinic mineral oil having a visocity at 100° C. of 8.3cSt and a second paraffinic mineral oil having a viscosity at 100° C. of 30.5cSt. In the case of the manual transmission, front and rear axles, manual axles, differential and auxiliary gear cases, the preferred lubricant is typically a mixture of a paraffinic mineral oil having a viscosity at 100° C. of 8.3cSt and a second paraffinic mineral oil having a viscosity at 100° C. of 30.5cSt. from about 0.1 to about 2.0 wt.% fatty acid amide, from about 0.1 to about 2.0 wt.% of boric acid, about 0.5 to about 6.0 wt.% of polyisobutenyl (MW 1000–1300).

The reaction product additive component of the lubricant composition of the instant invention is preferably prepared by first reacting substantially equimolar amounts of a dibasic acid anhydride and a hydrocarbon-substituted mono primary amine, mono primary etheramine or ether amine to produce an intermediate reaction product. This intermediate product s thereafter reacted with a substantially equimolar amount of a nitrogen-containing hetercyclic azole or polyalkylene polyamine to produce the prescribed reaction product additive.

The dibasic acid anhydride reactant which may be employed to prepare the reaction product is of the formula

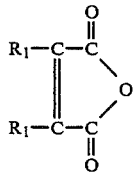

where $R_1$ is H, $CH_3$, or $C_2H_5$. Accordingly, dibasic acid anhydrides suitable for use include maleic anhydride, alphamethyl maleic anhydride, alpha-ethyl maleic anhydride and alpha, beta-dimethyl maleic anhydride. The preferred dibasic acid anhydride for use is maleic anhydride.

The hydrocarbon-substituted mono primary amine reactant which is employed to prepare to the prescribed reaction product is of one of two types. One type is represented by the formula $$R'—NH_2$$

in which R' is a monovalent straight-chained or branched-chain saturated or unsaturated ($C_6$–$C_{22}$) hydrocarbon radical. The second is a ($C_6$–$C_{22}$) hydrocarbon alkylene radical in which the divalent alkylene group has from about 1 to about 3 carbon atoms which is represented by the formula $$R'\text{-}O\text{-}R''\text{-}NH_2$$

in which R' is saturated ($C_{10}$–$C_{18}$) hydrocarbon radical and R'' is a ($C_1$–$C_3$) alkylene radical.

In one type of suitable hydrocarbon-substituted mono primary amine, R is an aliphatic radical having from about 10 to about 18 carbon atoms. Examples of amines of this type are those sold under the ARMEEN trademark by the Armak Co., and they include ARMEEN C (cocoamine) having a typical chain length distribution ranging from $C_8$ to $C_{18}$ ARMEEN OL (oleylamine) having a typical chain length distribution ranging from $C_{12}$ to $C_{18}$ with 76 percent being oleyl and ARMEEN T (talloamine) having a typical chain length distribution ranging from $C_{14}$ to $C_{18}$ with 29 percent being unsaturated $C_{16}$ groups.

In another type of suitable hydrocarbon-substituted amine, e.g., mono primary etheramine, R' is an aliphatic radical having from about 10 to about 18 carbons and R'' is a trimethylene radical.

These ether amines are sold by Exxon Chemicals under the trademark Tomah PA-14 or Tomah PA-17. Tomah PA-14 is a mixture of decoxypropylamines and Tomah PA-17 is a mixture of tridecoxy propylamines.

Another type of suitable hydrocarbon-substituted mono primary ether amine is represented by the formula $$R'-[O(CH_2)_n]_x-[OCH_2-\underset{\underset{CH_3}{|}}{CH}]_y-NH_2$$

in which R' is as defined above, x is another integer with a value of 0 or 1, y has a value of from 0 to 10, and n is an integer of from 1 to 5. These amines are sold by Texaco Chemical Co. under the JEFFAMINE trademark.

In the best mode of preparing the reaction product additive of the instant invention, the prescribed anhydride reactant is dissolve in a solvent such as xylene, hexane, or dimethyl formamide, and heated to about 60° C. Where the prescribed anhydride reactant is dibasic acid anhydride, the preferred solvent for use is xylene. An amount of the amine, N-hydrocarbyl ether amine or mono primary ether amine is then added to the solution such that substantially equimolar amounts of anhydride and amine reactants are present and the resultant mixture, if heated for 2 to 4 hours at 50° C. to 150° C., thereby forming the intermediate reactant product.

To the mixture containing the intermediate product, an amine is added. This amine is a nitrogen-containing heterocyclic azole selected from the group consisting of ortho, meta or para-tolyl-triazole and benzo-triazole, or a polyalkylene polyamine. The entire mixture is then heated to effect the reaction. In general, this is done by heating the mixture to the reflux temperature and maintaining it under these conditions for the required length of time. The reactant can generally be completed in from about 0.1 to about 10 hours, although longer time may be required for large quantities. The product is filtered and stripped under a vacuum.

As described above, the final reaction product additive, the intermediate reaction product, e.g., maleamic acid, could thereafter be reacted at elevated temperatures with a substantially equimolar amount of:

(i) a nitrogen-containing hetercyclic azole compound selected from the group consisting of a tolytriazole (TTZ) benzotriazole (BTZ); or (ii) a polyalkylene polyamine compound of the formula $$NH_2-(CH_2-NH)_n-H$$

in which n is an integer from 1 to 5, preferably 1 to 3.

The polyalkylene polyamine that may be used according to the present invention include ethylene diamine, diethylene triamine and triethylene tetraamine. The preferred polyamine being diethlene triamine.

The following examples illustrate the preferred method of preparing the reaction product additive of the instant invention. It will be understood that the following examples are merely illustrative and are not meant to limit the invention in any way. In the examples, all parts are parts by weight unless otherwise specified.

EXAMPLE I

Preparation of Maleic Anhydride, Hydrocarbon-Substituted Mono Primary Amine and BTZ Reaction Product Ninety-eight parts of maleic anhydride dissolved in 457 parts of xylene were heated to 60° C. Two hundred forty parts of Armeen-C were added and this mixture was reacted at 100° C. for two hours, then cooled to room temperature and 119 parts of BTZ added. This mixture was then reacted at the reflux temperature of xylene. After all the water of reaction was distilled off the heating was stopped and the reaction product was filtered and stripped of remaining solvent under a vacuum.

EXAMPLE II

Preparation of Maleic Anhydride, Hydrocarbon-Substituted Mono Primary Ether Amine and DETA Reaction Product Ninety-eight parts of maleic anhydride dissolved in 388 parts of xylene were heated to 60° C. Decyldioxyisopropylamine (JEFFAMINE M-300) in the amount of 289.5 parts were then added and this mixture was reacted at 100° C. for 2 hours andthen cooled to room temperature. One hundred fiftysix parts of the above mixture wer removed and added to 103 parts of DETA and 94 paarts of xylene. This mixture was then reacted at the reflux temepraature of xylene. This mixture was then reacted at the reflux temperature of xylene. After all the water of reaction was distilled off, the heating was stopped and the reaction product was filtered and stripped of remaining solvent under a vacuum.

EXAMPLE III

Preparation of Maleic Anhydride, Hydrocarbon-Substituted Mono Primary Ether Amine and BTZ Reaction Product Ninety-eight parts of maleic anhydride dissolved in 200 parts of xylene were heated to 60° C. Three hundred forty parts of decoxypropylene amine (TOMAH DAT-17) were then added and this mixture was reacted at 100° C. for 2 hours and then cooled to room temperature. One hundred three parts of BTZ then were added to the mixture and the entire mixture was reacted at the reflux temperature of xylene. After all the water of reaction was distilled off, the heating was stopped and the reaction product was filtered and stripped of remaining solvent under a vacuum.

The improvement in fuel economy brought about by the novel gear oil lubricant composition of the present invention was demonstrated in the Four-Ball, Coefficient of Friction Test where the apparatus used was as described below.

Apparatus: A four-ball wear test machine is used. Four balls are arranged in an equilateral tetrahedron. The lower three balls are clamped securely in a test cup filled with lubricant and the upper ball held by a chuck which is motor driven causing the upper ball to rotate against the fixed lower balls. A load is applied in an upward direction through a weight/lever arm system. Loading is incremental (minimum increment is 1.0 kg) except for the Roxana tester which has a continuously variable loading system. Heaters allow operation at elevated oil temperatures. On some machines, a strain arm system and accompanying instrumentation allow measurement and recording of friction. With the exception of the Roxana Machine, which has continuously variable speed control up to 3600 rpm, the test speeds available for each tester are 600 rpm, 1200 rpm and 1800 rpm.

In this test, the machines can be adapted to running wear tests using discs instead of balls in the test cup. Disc metals may be of bronze, brass, silver, aluminum and other materials upon request. The conditions of the various test procedures as to speed, load, temperature and time (i.e., duration) are provided below in Table I along with the type of result reported for each test.

TABLE I

| TEST PROCEDURES | One-Hour Wear | Navy Wear | One-Hour Wear | Two-Hour Wear |
|---|---|---|---|---|
| Test | | | | |
| Speed, rpm | 600 | 1800 | 1800 | 600 |
| Load, kg | 1, 10 and 40 | 28 | 40 | 40 |
| Temperature, °F. | 167 | Room | 200 | 200 |
| Duration, min. | 60 at each load | 10, 40, 70, 100 (separate run at each duration) | 60 | 120 |
| Type of Test Results: | Average scar diameter. Wear (microns — average scar diameter for each load per minute) | | | |

The frictional effects of the novel lubricating oil composition of the invention containing the prescribed instant invention friction modifier and anti-wear agent was evaluated in a commerical gear oil diesel lubricating oil composition. The commercial lubricant, or base oil, and the modified oil containing the friction modifier of the invention, were tested for their friction properties in the four-ball Friction Test described above.

The following results provided below in Table II, illustrate the effectiveness of the additive of the present invention in different gear oil compositions.

TABLE II

| FOUR-BALL COEFFICIENT OF FRICTION TEST | Base | Modified Gear Oil | | |
|---|---|---|---|---|
| Composition, Limit % | Blend | Oil A | Oil B | Oil C |
| Solvent Neutral Oil 20 (SNO 20)[a] | 52.5 | 52.5 | 52.5 | 52.5 |
| Bright Stock 150[b] | 39.45 | 39.45 | 39.45 | 39.45 |
| Anglamol 6046B[1] | 7.00 | 7.00 | 7.00 | 7.00 |
| dimethyl polysiloxane (Silicone)(antifoament)ppm | 250 | 250 | 250 | 250 |
| Example I | — | 1 | — | — |
| Example II | — | — | 1 | 1 |
| Coefficient of Friction (1 hr, 40 Kg/200 F./1800 rpm) at the end of the test | 0.08 | 0.057 | 0.056 | 0.057 |
| Average scar diameter, mm | 0.55 | 0.37 | 0.35 | 0.43 |

[a]SNO-20: a paraffinic mineral oil having a 100° C. viscosity of 8.3 cSt
[b]SNO-40: a paraffinic mineral oil having a 100° C. viscosity of 30.5 cSt
[1]1% fatty acid amide (i.e., oleyl, tallow or cocoyl acid and polyalkylene polyamine i.e., ethylene diamine, diethylene triamine), 1% boric acid, 5% polyisobutenylsuccinimide, 19% primene 81R salt of $P_2S_5$ heated 0,0[1]-di(methyl-2-pentyl) phosphorodithioate, 51% di-e-butylsulfides, 23% mineral oil.

The foregoing examples demonstraate an unexpected effectiveness of instant inventions as a friction modifier and anti-wear agents for reducing engine motor torque in the prescribed gear oil composition of the invention to provide attendant fuel economies. The different gear oil compositions set forth above in Table II are:

(a) Reaction product of Armen C, maleic anhydride and BTZ
(b) Reaction product of JEFFAMINE M-300, Maleic anhydride and DETA
(c) Reaction product of Tomah PA-17, maleic anhydride and BTZ

We claim:

1. A gear oil engine lubricant composition comprising
(a) a major portion of a gear lubricating oil and
(b) a minor amount of, as a friction modifying agent, a reaction product prepared by reacting
(i) a dibasic acid anhydride
(ii) a hydrocarbon-substituted amine selected from the group consisting of mono primary amine, etheramine and mono primary etheramine, and
(iii) a nitrogen containing compound selected from the group consisting of a hetercyclic azole and a polyalkylene polyamine.

2. A gear oil engine lubricant composition comprising
(a) a major portion of a gear lubricating oil, and
(b) a minor amount of, as a friction modifying agent, a reaction product prepared by the process comprising:
(i) reacting at a temperature ranging from 50° to 150° C. substantially equimolar amounts of a dibasic acid anhydride compound and a hydrocarbon-substituted mono primary amine $R'—NH_2$ in which R' is a monovalent ($C_6$–$C_{22}$) hydrocarbon radical to form an intermediate amic acid,

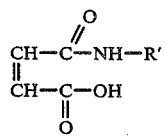

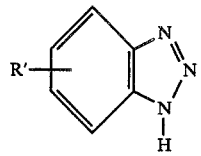

to form the reaction product, and
(iii) recovering said reaction product.

3. A gear oil engine lubricant composition comprising
(a) a major portion of a gear lubricating oil and
(b) a minor amount of, as a friction modifying agent, a reaction product prepared by the process comprising:
(b) a minor amount of, as a friction modifying agent, a reaction product prepared by the process comprising:
(i) reacting at a temperature ranging from 50° to 150° C. substantially equimolar amounts of a dibasic anhydride compound and a hydrocarbon-substituted primary amine of the formula $R'—O/R''—NH_2$ in which R'' is a monovalent straight-chain ($C_6$–$C_{22}$) hydrocarbon and R'' is a ($C_1$ to $C_3$) alkylene radical or a hydrocarbon-substituted mono primary etheramine of the formula $$R'—[O(CH_2)_n]_x—[OCH_2—\underset{\underset{CH_3}{|}}{CH}]_yNH_2$$

in which R' is a previously defined, x is an integer with a value of 0 to 1, y has a value from 0 to 16 and n is 1 to 3, to form an intermediate amic acid,

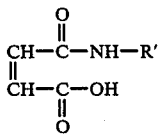

(ii) reacting the amic acid with a polyalkylene polyamine, $NH_2[CH_2CH_2—NH_2]_nCH_2CH_2NH$ to form the reaction product; and (iii) recovering said reaction product.

4. The lubricant composition of claim 1, wherein said anhydride compound is represented by the formula

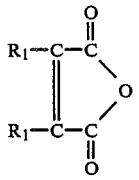

wherein $R_1$ H, $CH_3$ or $C_2H_5$.

5. The lubricant composition of claim 1, wherein the dibasic acid anhydride is maleic anhydride.

6. The lubricant composition of claim 1, wherein the hydrocarbon-substituted amine is non-primary amine.

7. The lubricant composition of claim 1, wherein said nitrogen containing compound is a heterocyclic azole.

8. The lubricant composition of claim 1, wherein the hydrocarbon-substituted amine is mono primary etheramine.

9. The lubricant composition of claim 1, wherein the hydrocarbon-substituted amine is etheramine.

10. The lubricant composition of claim 1, wherein said nitrogen containing compound is a polyalkylene polyamine.

11. The lubricant composition of claim 1, wherein said polyalkylene polyamine is diethylene triamine.

12. A gear oil engine lubricant composition comprising (a) a major portion of a gear lubricating oil and (b) a minor portion of, as a friction modifying agent, a reaction product prepared by reacing (i) maleic anhydride (ii) a hydrocarbon-substituted mono primary amine and (iii) a nitrogen containing heterocyclic azole.

* * * * *